US005672290A

United States Patent [19]

Levy et al.

[11] Patent Number: 5,672,290

[45] Date of Patent: Sep. 30, 1997

[54] POWER SOURCE AND METHOD FOR INDUCTION HEATING OF ARTICLES

[75] Inventors: Philippe F. Levy, Belmont, Calif.; Yasuharu Fukushige, Yokohama, Japan

[73] Assignee: Raychem Corporation, Menlo Park, Calif.

[21] Appl. No.: 403,032

[22] Filed: Mar. 13, 1995

[51] Int. Cl.[6] ..... H05B 6/06

[52] U.S. Cl. ..... 219/634; 219/633; 219/667; 156/274.2

[58] Field of Search ..... 219/634, 633, 219/661, 663, 665, 667; 156/272.4, 274.2

[56] References Cited

U.S. PATENT DOCUMENTS

| | | | |
|---|---|---|---|
| 4,032,740 | 6/1977 | Mittelmann | 219/667 |
| 4,693,767 | 9/1987 | Grzanna et al. | 156/49 |
| 4,755,648 | 7/1988 | Sawa | 219/10.77 |
| 4,972,042 | 11/1990 | Seabourne et al. | 174/23 R |
| 5,117,613 | 6/1992 | Pfaffmann | 219/633 |
| 5,129,977 | 7/1992 | Leatherman | 156/272.4 |
| 5,231,267 | 7/1993 | McGaffigan | 219/634 |
| 5,248,864 | 9/1993 | Kodokian | 219/633 |
| 5,378,879 | 1/1995 | Monovoukas | 219/634 |

FOREIGN PATENT DOCUMENTS

| | | |
|---|---|---|
| 0 171 604 | 2/1986 | European Pat. Off. . |
| 0 209 215 | 1/1987 | European Pat. Off. . |
| 0 355 423 A3 | 2/1990 | European Pat. Off. . |
| 0 404 209 | 12/1990 | European Pat. Off. . |

*Primary Examiner*—Philip H. Leung

*Attorney, Agent, or Firm*—Herbert G. Burkard; Sheri M. Novack

[57] ABSTRACT

A power source for induction heating of articles containing ferromagnetic particles. An arrangement including the article is exposed to an electromagnetic field at a first power level for a first predetermined period of time and, subsequently to an electromagnetic field at a second power level for a second predetermined period of time. In comparison to conventional power sources, the article may be exposed to an electromagnetic field for a longer period of time without damage.

15 Claims, 2 Drawing Sheets

POWER SOURCE AND METHOD FOR INDUCTION HEATING OF ARTICLES

This invention relates to a power source for heating an article by exposing the article to an electromagnetic field, and a method of heating an article.

BACKGROUND OF THE INVENTION

Various technologies require the heating of material to achieve a transition of the material from an initial state to a final state exhibiting desired characteristics. For example, heat is employed to recover polymeric heat recoverable articles such as heat recoverable tubing and molded parts, cure gels, melt or cure adhesives, activate foaming agents, dry inks, cure ceramics, initiate polymerization, initiate or speed up catalytic reactions, or heat-treat parts, among other applications.

The speed at which the material is heated is a significant consideration in the efficiency and effectiveness of the overall process. It is often difficult to obtain uniform heat distribution in the material through to its center. In instances where the center of the material is not adequately heated, the transition from the initial state to the final state may not fully or uniformly occur. Alternatively, in order to obtain the desired temperature at the center of the article, excessive heat may be required to be applied at the surface where such excessive temperature conditions can lead to degradation of the material surface.

Because of these disadvantages of external heating, bulk or internal heating methods are often preferred to provide fast, uniform, and efficient heating. As described in commonly assigned U.S. Pat. No. 5,378,879 issued on Jan. 3, 1995 to Monovoukas and entitled "Induction Heating of Loaded Materials" which is hereby incorporated by reference for all purposes, induction heating can be used to heat a non-conductive material in situ quickly, uniformly, selectively and in a controlled fashion. A non-magnetic and electrically non-conductive material is transparent to the magnetic field and, therefore, cannot couple with the field to generate heat. However, such a material may be heated by magnetic induction heating by uniformly distributing ferromagnetic particles within the material and exposing the article to an alternating high frequency electromagnetic field. Ferromagnetic particles for induction heating are added to the electrically non-conductive, non-magnetic host material and exposed to high frequency alternating electromagnetic fields such as those produced in an induction coil. The temperature of the ferromagnetic particles increases until the particles reach their Curie temperature and then, the particles are self-regulating at that temperature.

While induction heating of the ferromagnetic material is quick, effective and self-regulating in temperature, other components of the article may be damaged when subjected to the power levels used for heating of the ferromagnetic material. For example, in a case in which copper wires coated with insulation are present, the copper is inductively heated; however, copper does not have a Curie temperature, is not self-regulating in temperature and continues to heat as power is continuously supplied. Thus, the insulation surrounding the copper continues to heat due to heat generated by the copper and is, thereby, damaged. The window period, in which adequate heating of the article occurs without damage to components, may be extremely small, if it exists at all.

SUMMARY OF THE INVENTION

We have discovered that it is possible to extend the window period and improve the results of heating an article by induction heating by exposing the article to an electromagnetic field at a fast power level for a predetermined period of time and, subsequently, reducing the power level.

A first aspect of the invention comprises a method of heating an assembly by means of electromagnetic radiation, the assembly comprising:

(1) a composition which comprises:
- (a) a host material which is not heated by electromagnetic radiation, and
- (b) ferromagnetic particles which are dispersed in the host material and have a Curie temperature; and (2) a lossy component which is composed of a material which can be heated by the electromagnetic radiation and which does not have a Curie temperature;

said process comprising:
- (A) exposing the assembly to electromagnetic radiation of a first power which heats the ferromagnetic particles and the lossy component, and
- (B) immediately after step (A), exposing the assembly to electromagnetic radiation of a second power which heats the lossy component at a rate less than the radiation of the first power.

A second aspect of the invention comprises an apparatus for heating an article, said article comprising:

(1) a composition which comprises:
- (a) a host material; and
- (b) ferromagnetic particles dispersed in the host material; and (2) a lossy component which does not self-regulate in temperature; said apparatus comprising:
- (A) a power supply for supplying power to an induction heating coil;
- (B) a first setting for providing power at a first power level such that the ferromagnetic particles are heated by induction heating and reach a first temperature; and (3) a second setting for providing power at a second power level, wherein said second power level is reduced from said first power level, said second setting being such that the ferromagnetic particles are maintained at or near said first temperature while heat generated in other parts of the article is reduced.

An additional aspect of the invention comprises a blocked cable arrangement, including a plurality of metal wires, the arrangement comprising an adhesive including a host material in which ferromagnetic particles are dispersed, said adhesive having been heated by the following method:

(1) supplying power to the induction heating coil at a first power such that the ferromagnetic particles reach a first temperature; and (2) immediately after step (1), supplying power to the induction heating coil at a second power, the second power being less than the first power, such that the ferromagnetic particles are maintained at or near the first temperature, and heat generated in the wires is reduced, so that the heat generated in the arrangement is approximately equal to heat lost from the arrangement.

A further aspect of the invention comprises a method of heating an arrangement comprising:

(1) providing a plurality of metal wires;

(2) placing an article in dose proximity to the wires, wherein said article comprises:
- (a) a host material; and
- (b) ferromagnetic particles dispersed in the host material;

(3) providing a cover around said article;

(4) heating the arrangement by exposing it to electromagnetic radiation of an induction coil at a first power, wherein the ferromagnetic particles reach a first temperature in the range of 100° C. to 250° C.; and (5) immediately after step (4), heating the arrangement by exposing it to an electromagnetic field at a second power, the second power being from 10–50% of the first power, wherein the ferromagnetic particles are maintained at a temperature in the range of 100° C. to 250° C., while reducing heat generated in other parts of the arrangement; and wherein heat generated in other parts of the arrangement is approximately equal to heat lost from the arrangement.

Other features and advantages of the present invention will appear from the following description in which the preferred embodiment has been set forth in detail in conjunction with the accompanying drawings.

BRIEF DESCRIPTION OF THE PREFERRED EMBODIMENT

DETAILED DESCRIPTION OF THE PREFERRED EMBODIMENT

Figure 1:
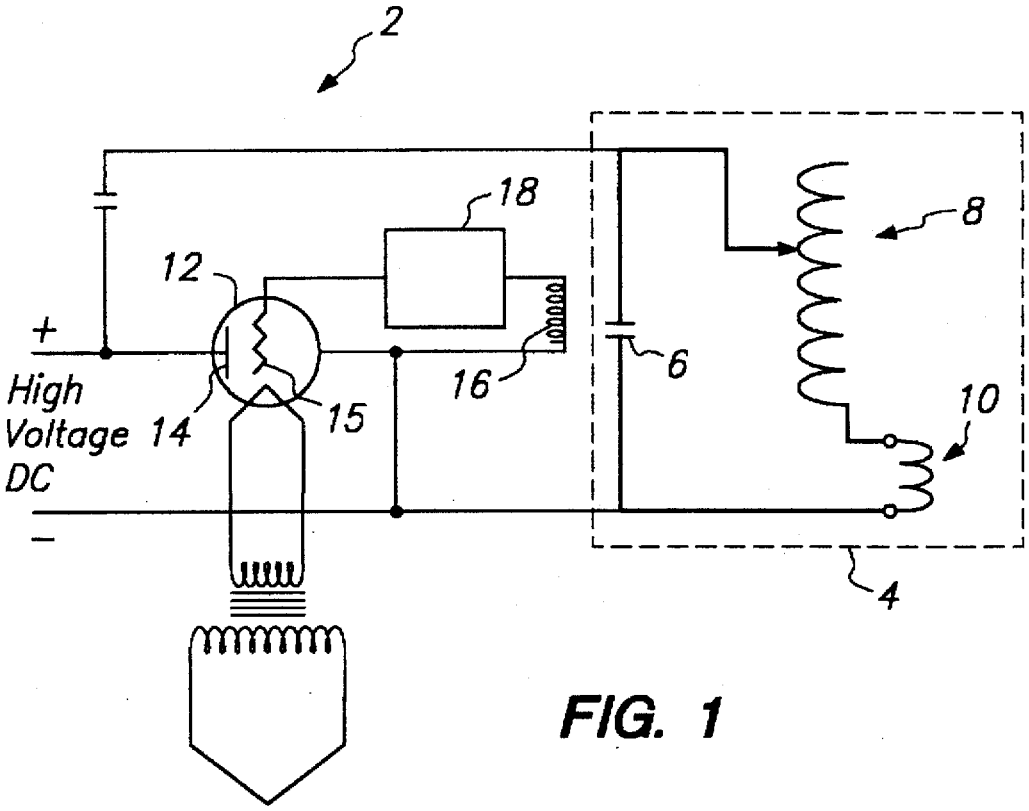
FIG. 1 illustrates a circuit diagram of the power source according to the present invention.

The present invention comprises an apparatus for heating an article by exposing it to an electromagnetic field, such as one produced in an induction coil. Induction heat is produced internally by exposing the article to electromagnetic fields. The article comprises a host material including ferromagnetic particles dispersed therein. Ferromagnetic particles, such as those disclosed by Monovoukas, referred to above, provide an efficient article that heats quickly, internally, uniformly and selectively, and is auto-regulating in temperature. In each application, the article is heated to transform it from its initial state to a new condition. The host material is electrically non-conductive and non-magnetic and may be any material which it may be desirable to heat treat. Examples include gels, adhesives, foams, inks, ceramics and polymeric heat recoverable articles, such as tubing. Heat recoverable articles are articles, the dimensional configuration of which may be made substantially to change when subjected to heat treatment. Usually, these articles recover, on heating, towards an original shape from which they have previously been deformed.

In typical prior art heating methods which apply only a single power, the power is maintained at a constant level even after the Curie temperature of the particles is reached. Any remaining components which are lossy continue to heat, such that the window period in which effective sealing is achieved without damage to components is relatively small, if it exists at all.

By reducing the power level after a predetermined period of time from a first power to a second power, the present invention provides a longer window period in which effective sealing may occur. Furthermore, in many instances which would not otherwise have a window period, the present invention creates a window in which effective sealing occurs. For some applications, the window period appears to be extended indefinitely, such that no burning of the host material occurs at the second, reduced power. (See, for example, Samples 11–22 as described in Table 1, below.)

Using the present invention, an article is heated quickly, while not causing damage to any component. The article, which in the present invention includes a lossy component such as metal wire, is heated by exposure to the electromagnetic field of the induction coil at a first power for a first predetermined period of time. Once the ferromagnetic particles in the host material reach their Curie temperature, the particles maintain their Curie temperature even with reduced power, although a minimum power is required. The article is then immediately heated at a second power for a second predetermined period of time, wherein the second power is reduced from the first. The first power and first predetermined period of time are such that the ferromagnetic particles reach a first temperature, preferably their Curie temperature, and wherein the second power is such that the ferromagnetic particles are maintained at or near the first temperature, while heat generated in other parts of the article, for example, copper of insulated wire, is reduced. Heat generated in these other parts of the article is approximately equal to heat lost through conduction and radiation. The first power level may be full power, while the second power level is just sufficient to maintain the host material at a temperature such that heat lost due to conduction and radiation is equal to the heat added to the article. Heat lost through conduction and radiation of the article can be measured with thermocouples or by examination of a cross section of the article. With this measurement, it is possible to determine the desired second power level. The second power level is preferably between 5–70%, more preferably between 10–50%, and most preferably between 15–40% of full power. The measurements of the thermocouples can also be used to determine the first and second predetermined periods of time. Once the desired temperature is reached at full power, the power level is reduced to the second power level, as described above. The second predetermined period of time is sufficient to ensure complete sealing, while still being within the window period.

The first and second powers and predetermined periods of time are set by first and second settings, respectively, which may be controlled by a single timer, or a separate timer for each power and corresponding predetermined period of time. It should be noted that while it is preferred that the ferromagnetic particles reach their Curie temperature upon exposure to the electromagnetic field at the first power level for the first predetermined period of time, it is not necessary to the present invention that the particles reach their Curie temperature and, in some cases, it may be preferable that the first temperature is less than the Curie temperature of the ferromagnetic particles.

In alternative embodiments, the method may include heating at an additional third power for a corresponding third predetermined period of time. The third power may be greater or less than the first and second powers and may even include completely stopping power for a predetermined period of time. If desired, the first and second powers and the third power, if applicable, may be resumed in cycles.

As described above, the ferromagnetic particles employed in the present invention are preferably those disclosed by Monovoukas, referred to above, in which the selection of particles results in faster, more uniform and more controlled heating. These particles advantageously have the configuration of a flake, i.e., a thin disk-like configuration. Heat-generating efficiency of these particles permits a smaller percentage volume of particles in the host material such that the desired properties of the host material remain essentially unchanged. The particles preferably employed in the present invention have a configuration including first, second and third orthogonal dimension, wherein each of the first and second orthogonal dimensions is at least 5 times the third orthogonal dimension. The first and second orthogonal dimensions, which are the larger of the dimensions, are preferably each between about 1 μm and about 300 μm. Also preferred is a composition containing ferromagnetic particles in an mount of between 0.5% and about 10% by volume. In some applications, for example, in cases where higher heat rates are desired and certain properties, such as viscosity, elongation to break, or conductivity may be compromised, rod-like particles or greater concentrations may be employed. It should be noted, however, that the present invention contemplates any composition or configuration of ferromagnetic particles.

FIG. 1 illustrates the circuit for a power generator 2 of oscillating voltage. Methods of developing the grid feedback signal vary from oscillator to oscillator. The present embodiment employs a 2.5 kW generator including a Hartley-type oscillator. The oscillating circuit includes a tank circuit 4.

Tank circuit 4 describes an apparatus consisting of a series of tank capacitors 6 connected in parallel with a tank coil 8 and a work coil 10. Energy stored in the capacitors is $CV^2/2$ where V is voltage charged by an equivalent capacitor C. This energy transfers over to the inductance L of the tank coil and work coil such that L=inductance of tank coil+ inductance of work coil and the energy returns again to capacitor 6. The speed of this energy oscillation process, i.e., frequency of oscillation, f, is dependent on the values of L and C such that $$f=\frac{1}{2\pi\sqrt{(L_{tank}+L_{work})(C_{tank})}}$$

In this way, attenuating oscillations occur because a certain amount of energy is dissipated by tank coil 8 and work coil 10. To compensate for these losses, tank circuit 4 is supplied additional power through a plate 14 of vacuum tube 12.

Tank coil 8 induces current in a grid coil 16. The tank and grid coil currents are 180° out of phase with each other. Grid coil 16 couples energy from tank coil 8 to grid 15 of vacuum tube 12. Grid circuit 18, by varying its voltage with respect to vacuum tube 12, controls the flow of electrons to tank circuit 4.

The oscillation effect in tank circuit 4 produces a large RF current in tank coil 8 and work coil 10. The passage of this large RF current through work coil 10 creates a magnetic field which generates heat proportionally. The article is placed within work coil 14 to be heated by induction.

FIG. 1 has been described with reference to a tank circuit generator having automatic matching of frequency. It should be noted, however, that a fixed frequency oscillator may also be employed.

Figure 2:
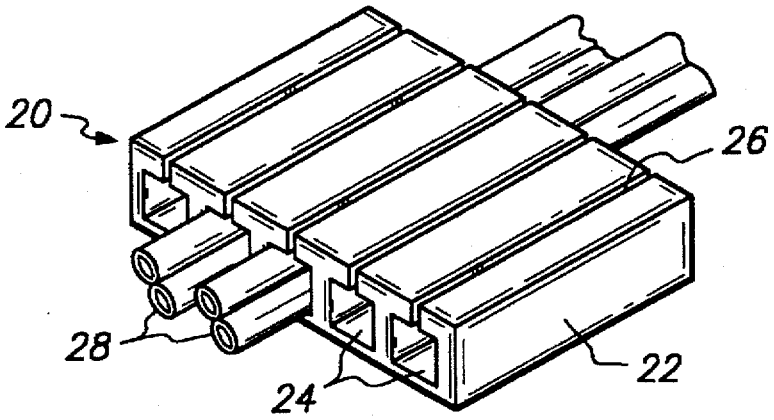
FIG. 2 illustrates a perspective view of an arrangement for forming a fluid block.

In a preferred embodiment, the present invention may be employed, for example, in an arrangement for forming a block in a cable against transmission of fluid along the cable, wherein the cable includes a plurality of wires, as described in Monovoukas, referred to above, and U.S. Pat. No. 4,972,042 entitled "Blocking Arrangement for Suppressing Fluid Transmission in Cables" issued on Nov. 20, 1990 to Seabourne et at, which is hereby incorporated by reference for all purposes. The cable blocking assembly, as shown in FIG. 2, comprises an adhesive including a host material in which ferromagnetic particles are dispersed therein. A cable blocking assembly 20 comprises a generally flat body construction 22 have approximately five open-ended passageways 24 extending therethrough. Each passageway 24 has a slot 26 associated with the passageway which enables an electrical wire 28 to be inserted into the passageway simply by positioning the wire along slot 26 and pressing the wire 28 into passageway 24. It is possible for any number of wires to be inserted into each passageway, depending on the relative dimensions of the wires and passageways. In the present embodiment, all slots are located on the same side of the construction. Although the body construction is illustrated as being a flat body, any type of body construction which may be disposed in proximity to the wires, either surrounding the wires of the wire bundle or positioned within the wire bundle, or any construction including openings for receiving the wires, is within the scope of the present invention.

The arrangement is placed within work coil 14 and heated by exposure to electromagnetic radiation having a first power for a first predetermined period of time. The temperature reached by ferromagnetic particles is in the range of 80° C. to 360° C., preferably in the range of 100° C. to 250° C., and most preferably in the range of 130° C. to 220° C. Immediately thereafter, the arrangement is heated by exposure to electromagnetic radiation having a second power for a second predetermined period of time, the second power being less than the first power, preferably in the range of 5–70%, more preferably in the range of 10–50%, and most preferably 15–40% oft he first power. The temperature of the ferromagnetic particles is maintained in the range of 80° C. to 360° C., preferably in the range of 100° C. to 250° C., and most preferably in the range of 130° C. to 220° C.

In the preferred embodiment, a cover is secured around the blocking structure to control flow of the composition as the viscosity of article 22 is reduced upon heating. The cover may be a heat recoverable sleeve placed around the blocking structure. A heat recoverable sleeve would recover as the blocking structure, and thus, the entire arrangement is heated. Alternatively, the cover may be removable. For example, the cover may comprise a polytetrafluoroethylene clamp which holds the blocking structure during heating, and which is removed thereafter.

Figure 3:
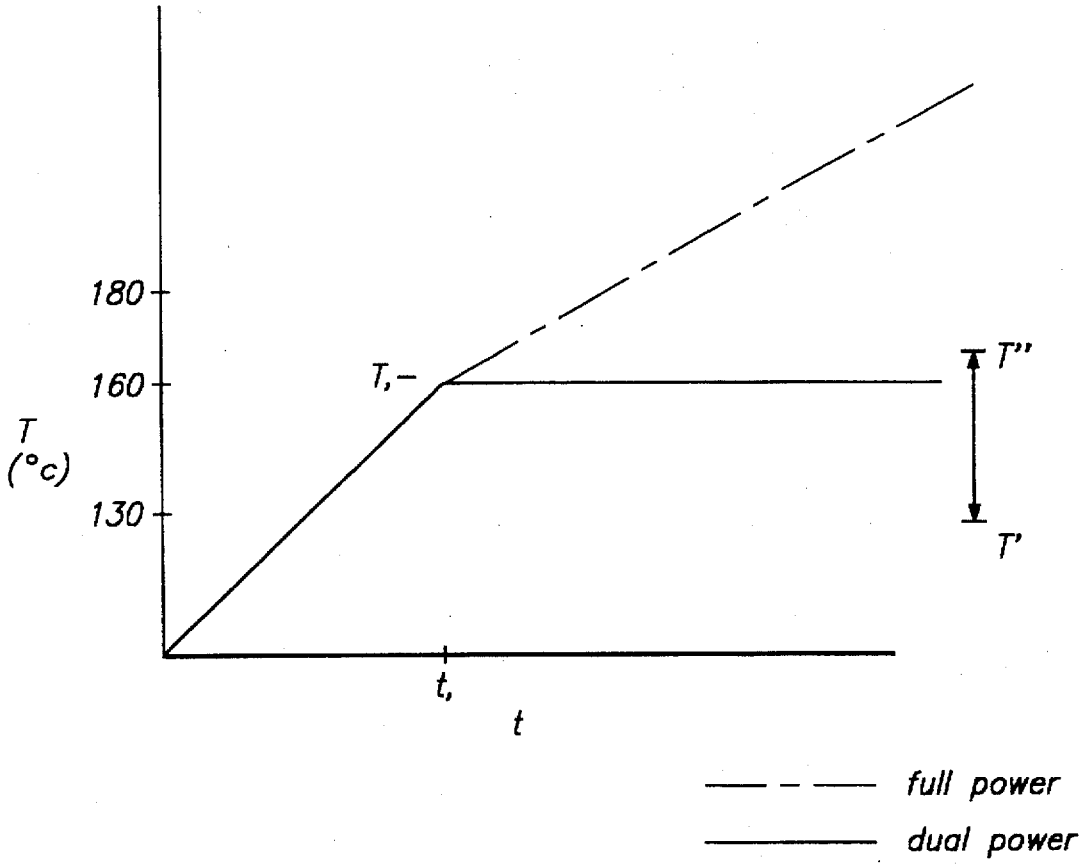
FIG. 3 is a graph which illustrates temperature versus time for an article subjected to the dual power system of the present invention.

FIG. 3 illustrates temperature (T) versus time (t) for an article being heated. Using dual power levels of the present invention, it can be seen that once the desired temperature $T_1$ is achieved at time $t_1$, power is reduced to a level such that heat generated by the lossy component, in this case the wires, is equal to the heat lost through conduction and radiation. In this way, the desired temperature of the arrangement is maintained. The second power level is sufficient to maintain the temperature of the arrangement in the working temperature range, which is between the sealing temperature, T', in this case approximately 130° C., and slightly above the desired temperature, T", in this case approximately 160° C. At full power, the temperature of the arrangement continues to heat (as also shown in FIG. 3), as the lossy component heats, eventually damaging the arrangement.

SAMPLES 1–14

Samples 1–9 and Comparative Samples 10–14 were prepared by providing one foot long bundles of 57 wires, each comprised of non-cross-linked polyethylene having a rating of 150° C. Each bundle consisted of 29 20-gauge wires, 17 18-gauge wires, 4 14-gauge wires, 4 single braided coax wires and 3 twisted pairs. The wires of each bundle were inserted into 6 five channel combs (such as article 22 as seen in FIG. 2) which were staggered. A length of 40 mm heat recoverable tubing was then placed around each bundle. Samples prepared according to the procedure for Samples 1–9 were exposed to an electromagnetic field by a U-channel induction coil at about 1500 W power, i.e., full power, for 26 seconds. Subsequently, power was reduced to about 500 W for additional periods of up to 28 seconds. Samples prepared according to the procedure for Samples 1–9 were calculated to have sealed 28 seconds after initial exposure. The wires prepared according to the procedure for Samples 1–9 were damaged after exposure to electromagnetic fields for 54 seconds (26 seconds at full power plus 28 second at reduced power). Comparative Samples 10–14 were exposed to an electromagnetic field by a U-channel induction coil at about 1500 W power, i.e., full power, for 24, 26, 28, 32 and 34 seconds, respectively. Samples prepared according to the procedure for Samples 10–14 were calculated to have sealed after 28 seconds. The wires prepared according to the procedure for Samples 10–14 were damaged 34 seconds after exposure to electromagnetic fields at full power. Thus, the window of Samples prepared according to the procedure for Samples 1–9 was 24 seconds (52 seconds total time less 28 seconds to seal). The window of Samples prepared according to the procedure for Samples 10–14 was 6 seconds (32 seconds total time less 26 seconds to seal).

SAMPLES 15–22

Samples 15–22 were prepared as Samples 1–14. Samples 15–22 were exposed to an electromagnetic field by a U-channel induction coil at about 1500 W power, i.e., full power, for 19 seconds. Subsequently, power was reduced to about 500 W for additional periods of up to 36 seconds. Samples prepared according to the procedure for Samples 15–22 were calculated to have sealed after 22 seconds. The wires prepared according to the procedure for Samples 15–22 showed no signs of damage after 58 seconds (19 seconds at full power plus 39 seconds at reduced power), when exposure to the electromagnetic field was stopped. The window of Samples prepared according to the procedure for Samples 15–22 was at least 36 seconds (58 seconds total time less 22 seconds to seal).

SAMPLES 23–31

Samples 23–31 were prepared as Samples 1–14. Samples 23–31 differed from the previous Samples in that the wires were nine feet long. Samples 23–31 were exposed to an electromagnetic field by a U-channel induction coil at about 1500 W power, i.e., full power for 26 seconds. Subsequently, power was reduced to about 500 W for additional periods of up to 30 seconds. Samples prepared according to the procedure for Samples 23–31 were calculated to have sealed after 30 seconds. The wires prepared according to the procedure for Samples 23–31 showed no signs of damage after 58 seconds (26 seconds at full power plus 32 seconds at reduced power), when exposure to the electromagnetic field was stopped. The window of Samples prepared according to the procedure for Samples 23–31 was at least 30 seconds (58 seconds total time less 28 seconds to seal).

TABLE I

| Sample # | Full Power Time (s) | Reduced Power Add'l Time (s) | Sealing Condition |
|---|---|---|---|
| 1 | 26 | 0 | not yet sealed |
| 2 | 26 | 2 | not yet sealed |
| 3 | 26 | 4 | sealed |
| 4 | 26 | 8 | sealed |
| 5 | 26 | 20 | sealed |
| 6 | 26 | 22 | sealed |
| 7 | 26 | 24 | sealed |
| 8 | 26 | 26 | sealed |
| 9 | 26 | 28 | damaged |
| 10* | 24 | 0 | not yet sealed |
| 11* | 26 | 0 | not yet sealed |
| 12* | 28 | 0 | sealed |
| 13* | 32 | 0 | sealed |
| 14* | 34 | 0 | damaged |
| 15 | 19 | 0 | not yet sealed |
| 16 | 19 | 3 | not yet sealed |
| 17 | 19 | 5 | sealed |
| 18 | 19 | 23 | sealed |
| 19 | 19 | 29 | sealed |
| 20 | 19 | 33 | sealed |
| 21 | 19 | 37 | sealed |
| 22 | 19 | 39 | sealed |
| 23 | 26 | 0 | not yet sealed |
| 24 | 26 | 2 | not yet sealed |
| 25 | 26 | 4 | sealed |
| 26 | 26 | 8 | sealed |
| 27 | 26 | 10 | sealed |
| 28 | 26 | 24 | sealed |
| 29 | 26 | 26 | sealed |
| 30 | 26 | 28 | sealed |
| 31 | 26 | 30 | sealed |

*Comparative Samples

The Examples set forth above illustrate the invention with respect to an embodiment including ferromagnetic particles dispersed in an adhesive. As described above, it should be noted that ferromagnetic particles may be dispersed within the host material of any article to be heated, such as gels, foams, inks, ceramics or polymeric heat recoverable articles.

What is claimed is:

1. A method of heating an assembly by means of electromagnetic radiation, the assembly comprising:

(1) a composition which comprises:

(a) a host material which is not heated by electromagnetic radiation, and (b) ferromagnetic particles which are dispersed in the host material and have a Curie temperature; and (2) a lossy component which is composed of a material which can be heated by the electromagnetic radiation and which does not have a Curie temperature; said process comprising:

(A) exposing the assembly to electromagnetic radiation of a first power which heats the ferromagnetic particles and the lossy component to a first temperature, said first temperature being at or near the Curie temperature of the ferromagnetic particles, and (B) immediately after step (A), exposing the assembly to electromagnetic radiation of a second power which heats the lossy component at a rate less than the radiation of the first power, the second power being such that the heat generated within the lossy component is approximately equal to heat lost from the assembly.

2. The method as defined in claim 1 wherein the ferromagnetic particles are maintained at or near said first temperature in step (B).

3. The method as defined in claim 2 wherein said first temperature is in the range of 100° C. to 250° C.

4. The method as defined in claim 1 wherein the second power is from 10–50% of the first power.

5. The method as defined in claim 1 wherein the lossy component is a metal wire and is surrounded by a polymeric insulation.

6. The method as defined in claim 1 wherein the lossy component is a solid throughout steps (A) and (B) and the composition flows during step (B).

7. The method as defined in claim 6 wherein the assembly further comprises a cover which controls flow of the composition during step (B).

8. The method as defined in claim 7 wherein the cover comprises a heat recoverable sleeve, and the sleeve is recovered in steps (A) and (B).

9. The method as defined in claim 7 wherein the cover is removable.

10. An apparatus for heating an article, said article comprising:

(1) a composition which comprises:
  (a) a host material; and
  (b) ferromagnetic particles dispersed in the host material; and (2) a lossy component which does not self-regulate in temperature; said apparatus comprising:
  (A) a power supply for supplying power to an induction heating coil;
  (B) a first setting for providing power at a first power level such that the ferromagnetic particles are heated by induction heating and reach a first temperature, said first temperature being at or near the Curie temperature of the ferromagnetic particles; and (3) a second setting for providing power at a second power level, wherein said second power level is reduced from said first power level, said second setting being such that the ferromagnetic particles are maintained at or near said first temperature while heat generated in other parts of the article is reduced by an amount approximately equal to heat lost from the article.

11. The method as defined in claim 10 wherein said first temperature is in the range of 100° C. to 250° C.

12. A method of heating an arrangement comprising:

(1) providing a plurality of metal wires;

(2) placing an article in close proximity to the wires, wherein said article comprises:
  (a) a host material; and
  (b) ferromagnetic particles dispersed in the host material;

(3) providing a cover around said article;

(4) heating the arrangement by exposing it to electromagnetic radiation of an induction coil at a first power, wherein the ferromagnetic particles reach a first temperature in the range of 100° C. to 250° C.; and (5) immediately after step (4), heating the arrangement by exposing it to an electromagnetic field at a second power, the second power being from 10–50% of the first power, wherein the ferromagnetic particles are maintained at a temperature in the range of 100° C. to 250° C., while reducing heat generated in other parts of the arrangement; and wherein heat generated in other parts of the arrangement is approximately equal to heat lost from the arrangement.

13. The method as defined in claim 12 further comprising securing the cover around said blocking construction prior to step (4).

14. The method as defined in claim 12 wherein the cover comprises a heat shrinkable sleeve, and the sleeve is recovered in steps (4) and (5).

15. The method as defined in claim 12 wherein said first temperature is at or near the Curie temperature of the ferromagnetic particles.

* * * * *